US006293782B1

(12) United States Patent
Tsai

(10) Patent No.: US 6,293,782 B1
(45) Date of Patent: Sep. 25, 2001

(54) SAFETY DEVICE FOR GAS BURNER

(76) Inventor: Chin-Lin Tsai, No. 94, Sec. 4, Chung Hsin Road, San Chung City, Taipei Hsien (TW)

( * ) Notice: Subject to any disclaimer, the term of this patent is extended or adjusted under 35 U.S.C. 154(b) by 0 days.

(21) Appl. No.: 09/639,845

(22) Filed: Aug. 16, 2000

(30) Foreign Application Priority Data

Aug. 5, 2000 (TW) ..... 89213608 U

(51) Int. Cl.[7] ..... F23Q 2/28
(52) U.S. Cl. ..... 431/153; 431/255
(58) Field of Search ..... 431/153, 255, 431/344; 222/133, 153.14, 153.12, 3; 126/405, 406, 407

(56) References Cited

U.S. PATENT DOCUMENTS 5,492,468 * 2/1996 Cirami ..... 431/153
5,505,614 * 4/1996 Lin ..... 431/255
5,667,377 * 9/1997 Lin ..... 431/344
6,196,833 * 3/2001 Ho ..... 431/153

* cited by examiner

*Primary Examiner*—Sara Clarke
(74) *Attorney, Agent, or Firm*—Dougherty & Troxell

(57) ABSTRACT

A safety device for gas burner includes a securing member, a press member, a slidable member, a retaining member and a button member. By manipulating the press member downwardly to reduce the height thereof, a connecting rod of the slidable member displaces as a result of loss of support from a lap piece, with an abutting rod contacting a stop ice. The connecting rod laps an upper portion of the lap piece so that the press member cannot rebound and is positioned. At this time, when the button member is pressed, an ignition means is simultaneously actuated, and the wall hook causes a gas supply means to supply fuel gas to a burner device. The fuel gas is ignited by means of the ignition means, and a wall rod abuts against a trigger rod. By pressing the retaining member, a fastening rod fastens the gas supply means in position to maintain supply of fuel gas. After use, the button member returns to its original position and is automatically retained by the press member.

11 Claims, 8 Drawing Sheets

IV–IV

V - V

VI – VI

VII – VII

SAFETY DEVICE FOR GAS BURNER

BACKGROUND OF THE INVENTION

1. Field of the Invention

The present invention relates to a safety device for a gas burner, more particularly to a safety device adapted for use in different models of gas burners. The safety device can be automatically locked after use of the gas burner so as to ensure safety.

2. Description of Related Art

There are numerous instances of fire accidents caused by children playing with gas burners or stoves. Therefore, many countries have made relevant safety regulations stipulating installation of safety devices on gas burners, such as those disclosed in U.S. Pat. Nos. 5,460,521 and 5,741,128 to the inventor of this invention. According to these patents, when a gas burner is not in use, it is in a locked state. To use the gas burner, the safety device has to be released. The releasing operation is quite complicated, thereby making it relatively difficult for children to conduct. However, the safety device has to be locked manually after use, which is not very convenient.

SUMMARY OF THE INVENTION

The object of the invention is to provide a safety device for a gas burner to eliminate the drawbacks with the prior art.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENTS

Figure 1:
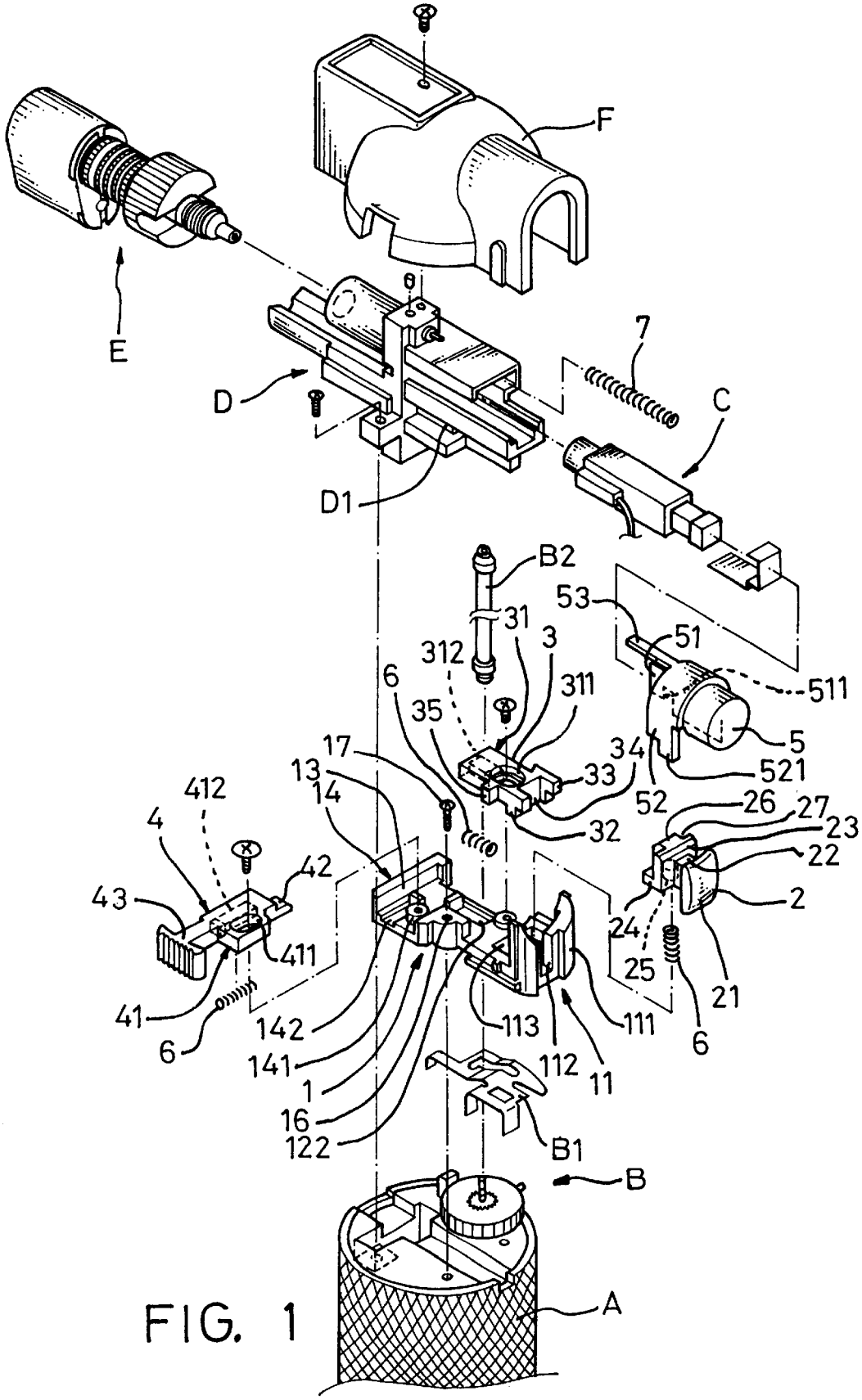
FIG. 1 is an exploded perspective view of a safety device of the present invention and a gas burner.

With reference to FIGS. 1 to 4, the preferred embodiment of a safety device according to the present invention includes a securing member 1, a press member 2, a slidable member 3, a retaining member 4, and a button member 5.

The securing member 1 is in the form of a seat fixedly provided on the top of a liquefied gas container (A). One side of the securing member 1 has a bearing means 11 projecting therefrom, which includes two support posts 111 with a guide groove 112 therebetween for insertion of the press member 2 and straddling of the button member 5. The inner side of the guide groove 112 is formed with a guide chamber 113 communicated therewith for receiving and positioning the press member 2 when the latter displaces downward. Further, between the bearing means 11 and a wall edge 13 on the opposite side, there are disposed a connecting means 12 and a pivotal connecting means 14. The connecting means 12 includes a first positioning pin 121 and a first positioning groove 122 for connection and positioning of the slidable member 3. The pivotal connecting means includes a second positioning pin 141 and a second positioning groove 142 for connection and positioning of the retaining member 4. In addition, in order that the securing member 1 can be connected to a supporting means (D), the bottom portion thereof corresponding to a support post (D1) of the supporting means (D) is provided with a seat groove 15 (see FIG. 3) such that the securing member 1 can slidably displace along the support rod (D1) and be positioned. In addition, the securing member 1 is provided with a connecting hole 16 in a suitable position for passage of a threaded rod 17 to secure fixedly the securing member 1 on the top of the gas container (A).

The press member 2 is in the form of a key that has one side provided with a press key 21 and a key neck 22. The key neck 22 is inserted into the guide groove 112 and the press key 21 is exposed therefrom between two support posts 111. In addition, the other side of the key neck 22 has a stop piece 23 extending integrally and longitudinally therefrom and having a width corresponding to that of the guide groove 113. The bottom portion has a lap piece 24 extending laterally therefrom and being provided with a connecting hole 25 for receiving a retractable element 6, such as spring. An upright post 26 is disposed between stop piece 23 and lap piece 24 as reinforcement. The two lateral sides thereof are respectively formed with a connecting groove 27. When the press member 2 is not actuated, the stop piece 23 abuts against a bottom edge of the button member 5 to prevent it from pressing an ignition means (C). When the press member 2 is manipulated downwardly, the lap piece 24 is received in the guide chamber 113 to compress the retractable element 6 so that the overall height is reduced. Then, the button member 5, unblocked by the stop piece, can proceed with pressing.

The slidable member 3 is a one-piece member having a sliding means 31 disposed on one side to corresponding to the connecting means 12, with a retractable element 6, such as a spring, disposed therebetween, so that the slidable member 3 can horizontally displace relative to the securing member 1. The sliding means 31 includes an elongated fitting hole 311 engaging the first securing pin 121 so that the slidable member 3 can displace along the surface of the securing member 1. A slide groove 312 in one side of the bottom side of the fitting hole 311 cooperates with the first positioning groove 122 to enclose a retractable element 6. When the slidable member 3 is subjected to an external force, it will compress the retractable element 6 to generate displacement. In addition, the bottom portion on the other side of the slidable member 3 is provided with a connecting rod 32 and an abutting rod 33 extending from a front end thereof such that a clearance is defined therebetween. The abutting rod 33 is formed with a rod groove 34 corresponding to the upright post 26 to facilitate insertable connection of the two. When the press member 2 is not actuated, the lap piece 24 abuts against the connecting rod 32, and there is a clearance between the abutting rod 33 and stop piece 23. When the press member 2 is manipulated downwardly, due to reduction in height, the slidable member 3 will displace laterally as a result of extension of the retractable element 6, thereby causing the abutting rod 33 to contact the stop piece 23, and the connecting rod 32 to lap on the lap piece 24. As such, the press member 2 cannot bounce back, i.e. resume its original position, thereby relieving the interference against the button member 5. Further, the slidable member 3 has a trigger rod 35 extending laterally therefrom, which is linked up with the button member 5.

The retaining member 4 is also a one-piece member. A middle portion thereof is provided with a sliding means 41 corresponding to the pivotal connecting means 14, with a retractable element 6, such as spring, disposed therebetween, so that the retaining member 4 can horizontally displace relative to the securing member 1. The sliding means 41 includes an elongated fitting hole 411 for receiving the second positioning pin 141 so that the retaining member 4 can displace along the surface of the securing member 1. A sliding groove 412 in one side of a bottom side of the fitting hole 411 cooperates with the second positioning groove 142 to enclose a retractable element 6. When the retaining member 4 is subjected to an external force, it will compress the retractable element 6 to generate displacement. In addition, the retaining member 4 has a fastening rod 42 projecting from an inner side thereof, and a press rod 43 provided on an outer side thereof. When a sliding plate (B1) of a gas release means (B) is pushed by the button member 5, gas is supplied. At this time, by pressing a press rod 43 to bring the fastening rod 42 into engagement with the sliding plate (B1), the sliding plate (B1) can be prevented from resuming its original position, thereby ensuring continuous supply of fuel gas to the supporting means (D).

The button member 5 is a push button straddling the bearing means 11. The front and rear side walls 51, 52 thereof straddle the surface of the securing member 1, and are respectively provided with a wall hook 511 and a wall rod 521 for connecting the sliding plate (B1) of the gas release means (B) and forming a contact relationship with the trigger rod 35. In addition, the top portion of the button member 5 is provided with a guide piece 53 straddling a support plane of the supporting means (D) so as to serve as a basis for displacement. Moreover, a biasing element 7, such as a spring, is disposed between the supporting means (D) and the side wall 51 to enhance the resilience of the button member 5. In the present invention, after assembly of the safety device and the burner, only the button member 5, push button 21 and press rod 43 will be exposed on the outside of a top cover F.

Figure 2:
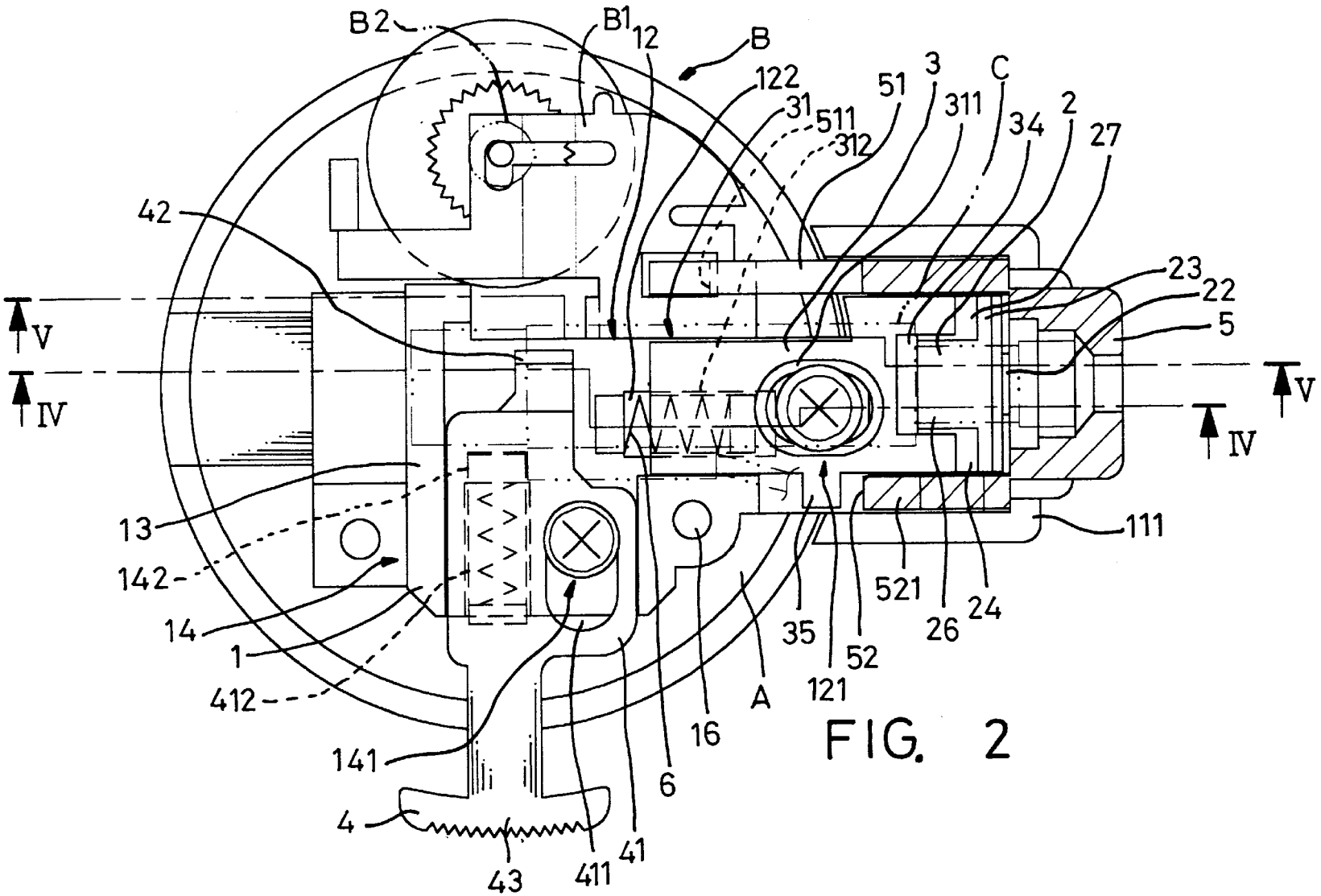
FIG. 2 is a top sectional view of FIG. 1 in an assembled state and prior to operation.
Figure 3:
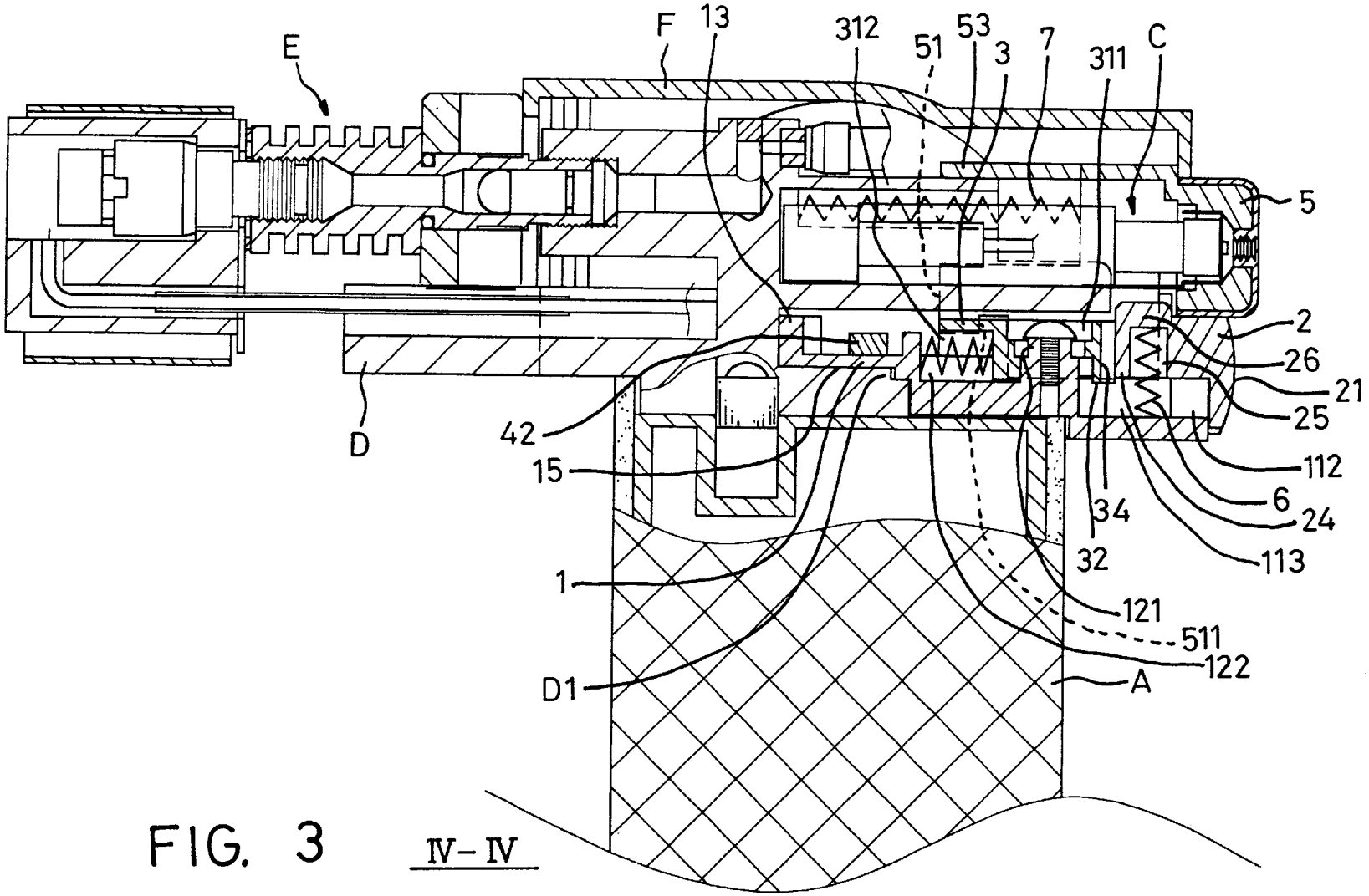
FIG. 3 is a sectional view taken along line IV—IV of FIG. 2.
Figure 4:
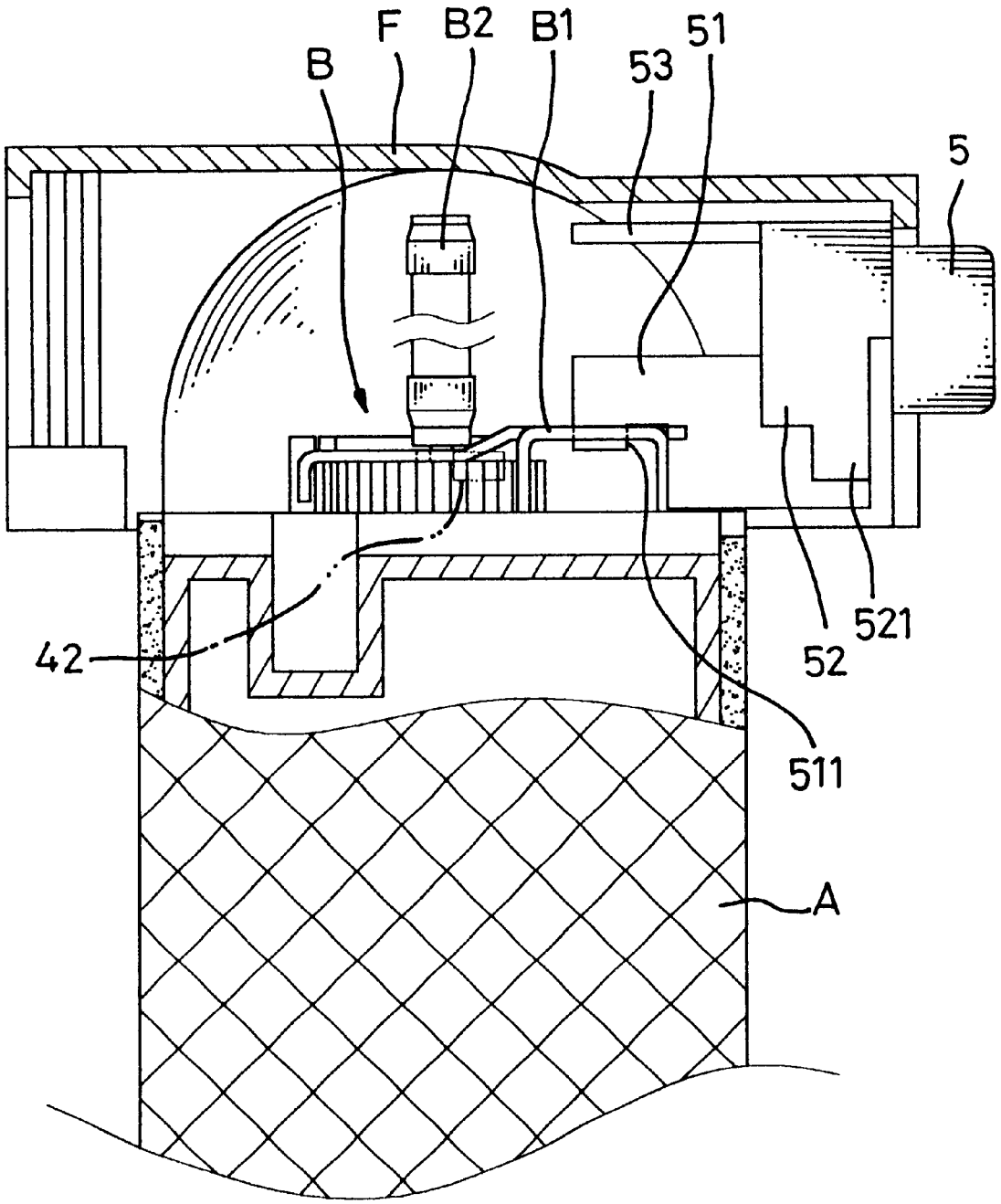
FIG. 4 is a sectional view taken along line V—V of FIG. 2.
Figure 5:
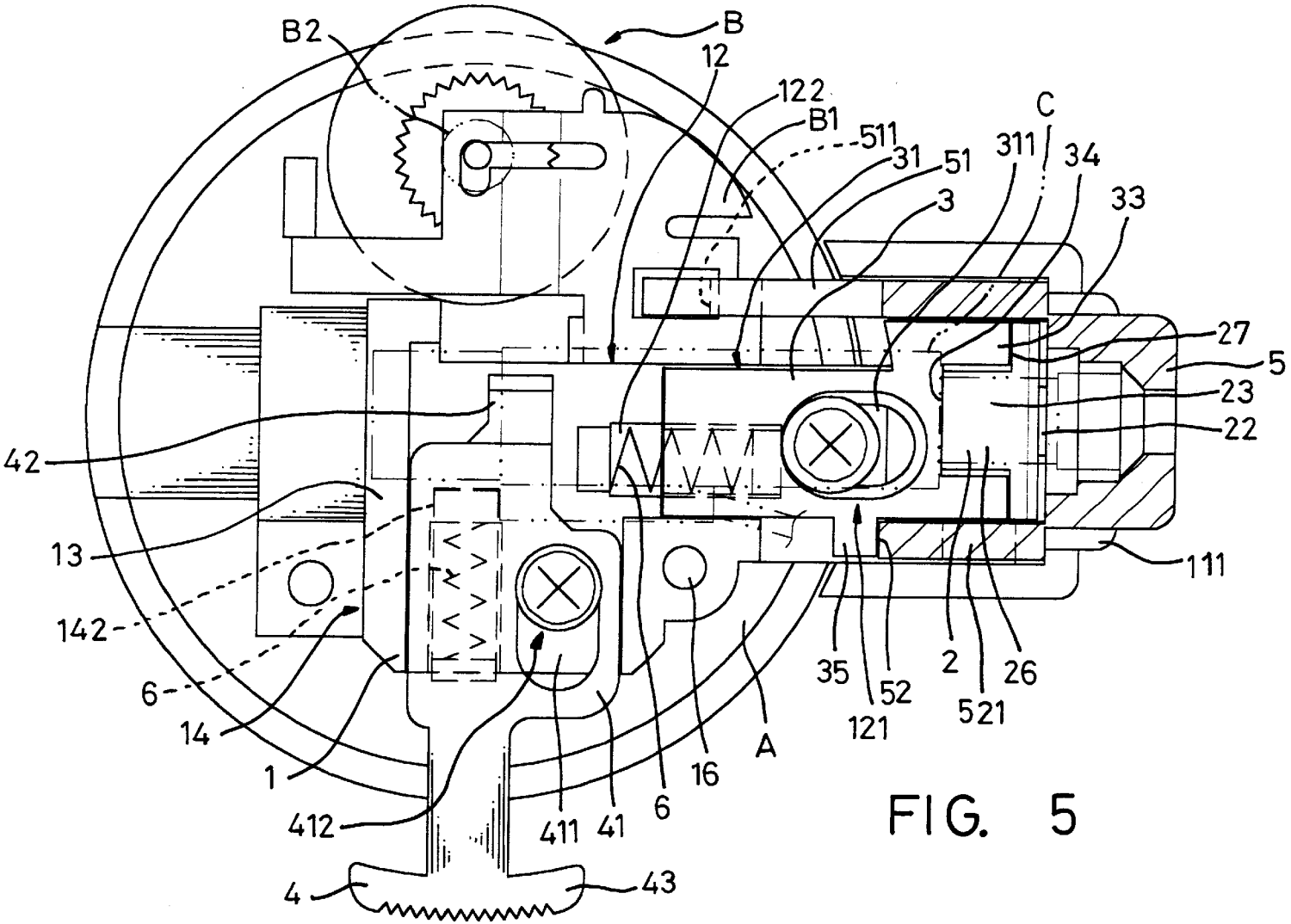
FIG. 5 is a top sectional view of the present invention illustrating how the safety device is released.
Figure 6:
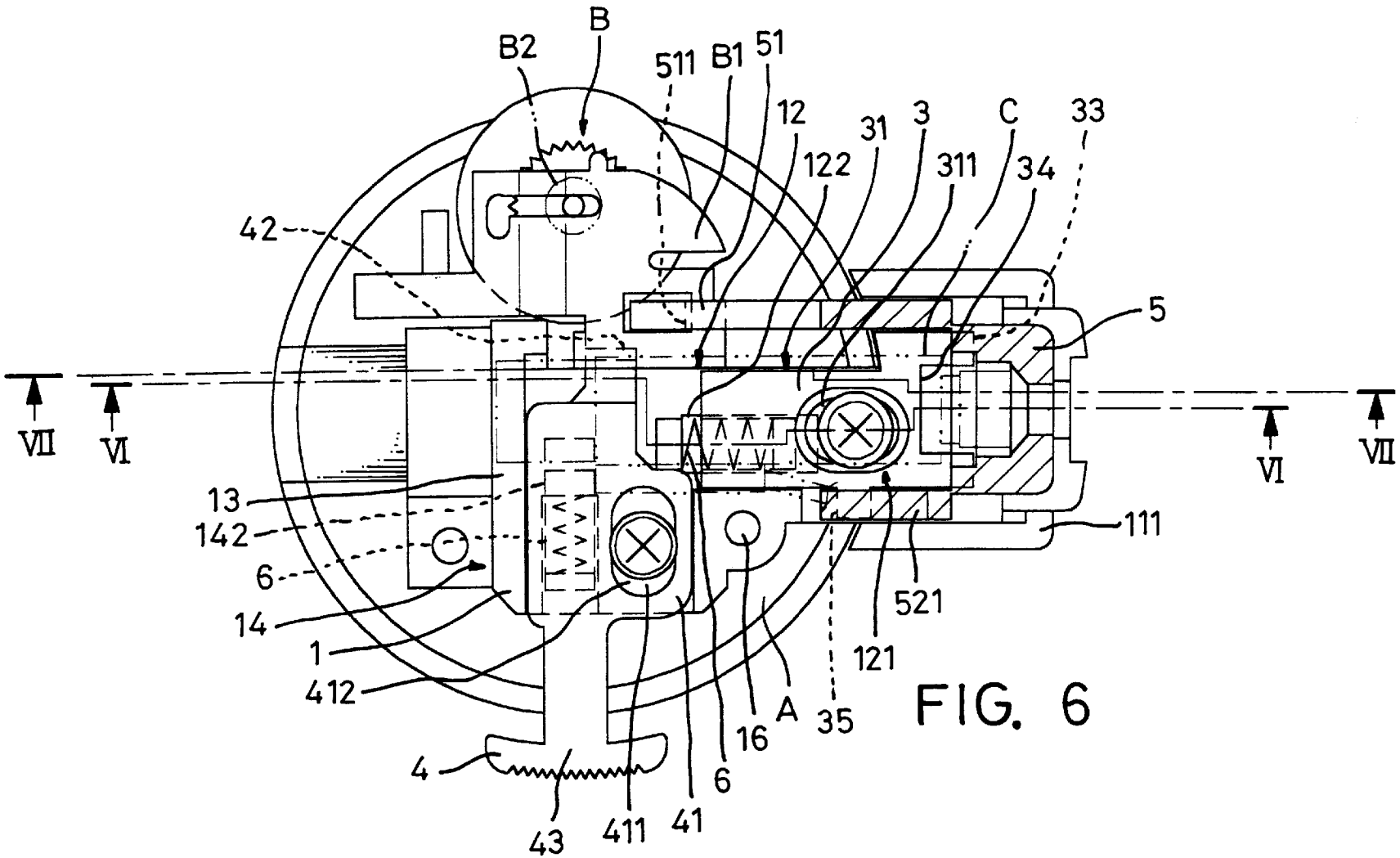
FIG. 6 is a top sectional view of the present invention showing the safety device in a released state.
Figure 7:
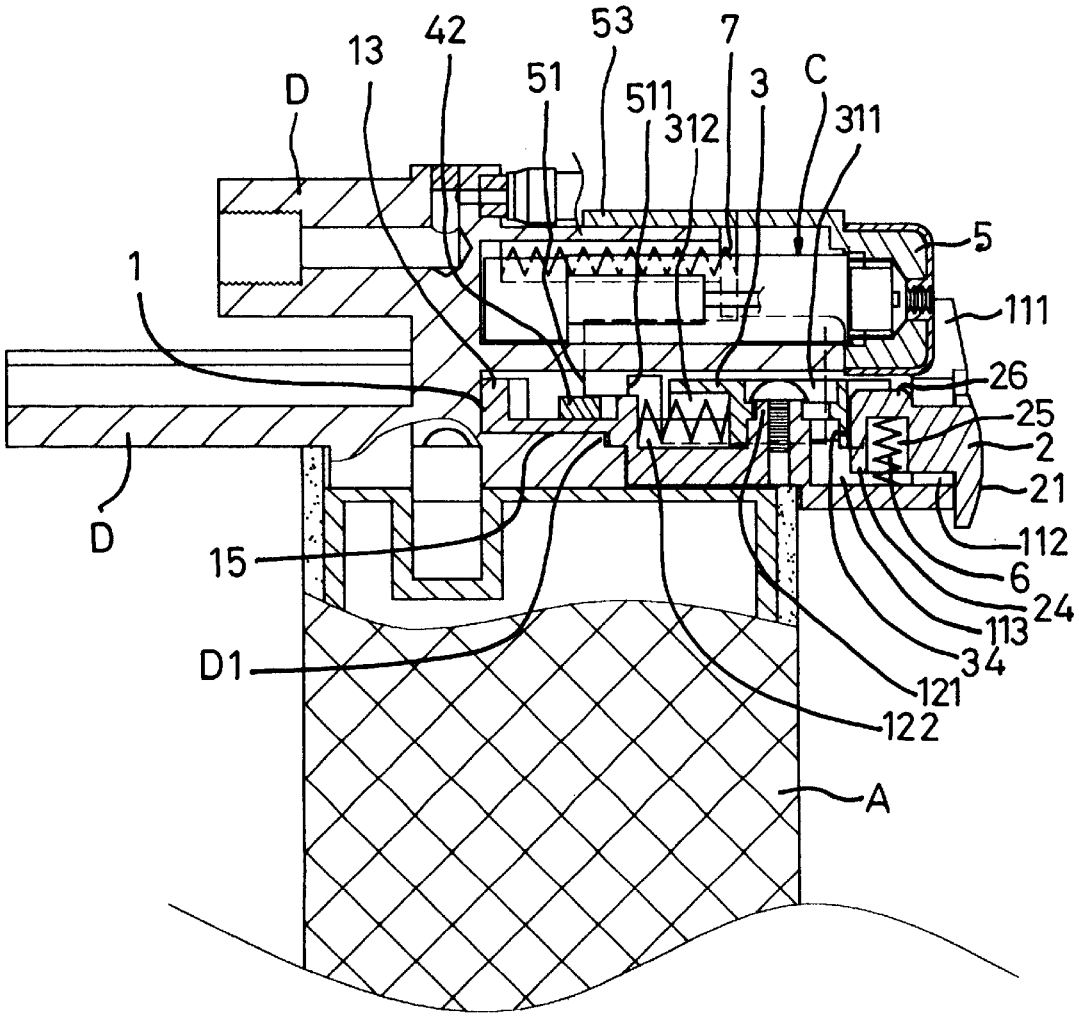
FIG. 7 is a sectional view taken along line VI—VI of FIG. 6.
Figure 8:
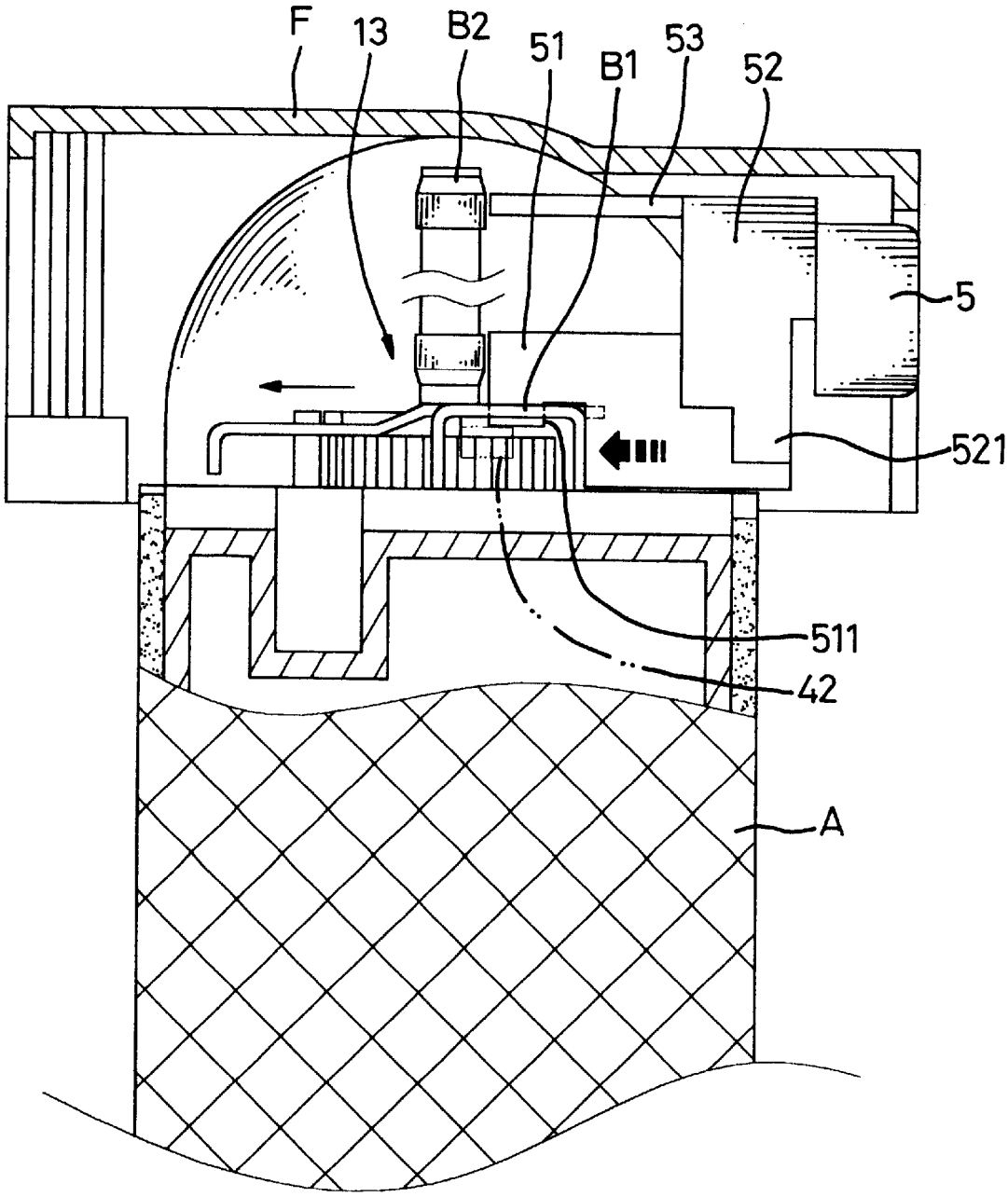
FIG. 8 is a sectional view taken along line VII—VII of FIG. 6.

With further reference to FIGS. 2 to 8, prior to operation, the abutting rod 33 of the slidable member 3 is received in the connecting groove 27, with the connecting rod 32 abutting against the lap piece 24, and the stop piece 23 abutting against the bottom edge of the button member 5 so the latter cannot be pressed. At this time, the wall hook 511 of the press member 5 maintains a secure connecting relationship with the sliding plate (B1), as shown in FIGS. 2 to 4.

When it is desired to proceed burning operation, press member 2 is manipulated downwardly so that it compresses the retractable element 6 at the bottom portion thereof, and lap piece 24 drops into guide groove 113. At this time, connecting rod 32 is unsupported so that retractable element 6 within slidable member 3 extends to horizontally displace, thereby bringing abutting rod 33 to contact stop piece 23, and connecting rod 32 to displace to above lap piece 24. Hence, press member 2 cannot bounce back (see FIG. 5). At this point, the bottom edge of button member 5 is released from the retaining state due to downward displacement of stop piece 23 so that the pressing operation can be proceeded (see FIGS. 6 and 7) to move the side walls 51, 52 and guide piece 53 of the button member 5 towards the burner and compress ignition means (C). At the same time, wall hook 511 will push the sliding plate (B1) to pull up a gas nozzle for supply of gas. The fuel gas passes through an outlet tube (B2) into support means (D) and is ejected via a burning means (E). The fuel gas is then ignited by means of ignition means (C). Then, by pressing button member 5 with one hand, and pressing press rod 43 of retaining member 4 with the other to compress retractable element 6 to displace, the fastening rod 42 at the other end will extend into sliding plate (B1). At this time, by pressing button member 5 slightly to fasten fastening rod 42 to gas means (B), retaining member 4 cannot bounce back. Hence, burning operation can proceed. Particularly, when button member 5 is pressed, wall rod 521 will push trigger rod 35 so that slidable member 3 slightly compresses retractable element 6 to bring connecting rod 32 to once again abut against lap piece 24. Press member 2 will elevate slightly and is pressed by button member 5 so that it cannot resume its original position.

When not in use, button member 5 is pressed again (see FIG. 6) so that fastening rod 42, due to displacement of sliding plate (B1), is not retained thereby, and can resume its original position due to extension of retractable element 6. Sliding plate (B1), due to disengagement of retaining member 4, and by means of ignition means (C) and biasing action of biasing element 7, displaces outwardly together with button member 5. At this time, abutting rod 33 in connecting groove 27 gradually moves away from stop piece. When button member 5 resumes its original position, press member 2, due to extension of retractable element 6, elevates to the full, with lap piece 24 abutting against connecting rod 32 so that slidable member compress the retractable spring therewithin. Hence, all the components resume their original positions as shown in FIGS. 2 to 4. At this time, button member 5 is once again retained by press member 2 and hence cannot be pressed.

In use, the user must first of all release the safety device of the present invention to make the operation procedure relatively difficult. In other words, in use, the press member has to be pressed so that the slidable member displaces and is positioned prior to pressing of the button member to permit control of ignition and gas supply means. Then, by pressing the button member, with one hand and the retaining member with the other hand to cause it to connect to the gas supply means during the process of displacement and to keep the button member in a constantly pressed state, thereby informing the user that the fuel gas is in a continuous supply state. In addition, after use, the safety device will be automatically locked lest that the user should forget to reset the safety device of the invention to a use state. Furthermore, the press member is disposed below the button member to avoid exposure to children. The complicated release procedure required by the safety device of the invention also helps to prevent accidents caused by children playing with gas burners. Besides, the components of the invention are modularized to facilitate assembly. The invention can be pre-assembled and then installed in a gas burner disclosed in the drawings or in a burner disclosed in the above-mentioned U.S. Pat. No. 5,741,128.

Although the present invention has been illustrated and described with reference to the preferred embodiment thereof, it should be understood that it is in no way limited to the details of such embodiment but is capable of numerous modifications within the scope of the appended claims.

What is claimed is:

1. A safety device for a gas burner, comprising:

a securing member in the form of a seat member fixedly provided above a liquefied gas container, one side thereof having a bearing means projecting therefrom and an opposite side thereof having a wall edge, a connecting means and a pivotal connecting means being disposed between said wall edge and said bearing means, said securing member having a surface;

a press member in the form of a key member, a bottom portion of one side thereof being connected to a retractable element and insertably disposed in said bearing means such that said press member can be longitudinally displaced therewithin, an opposite side of said press member being provided with a vertically extending stop piece, a bottom side thereof having a lap piece extending laterally therefrom;

a slidable member in the form of a plate, one side thereof having a sliding means connected to a retractable element and said connecting means such that it can be horizontally displaced along the surface of said securing member, a bottom portion of an opposite side of said slidable member being provided with a connecting rod, a front end thereof having an abutting rod extending therefrom, said connecting rod abutting against said lap piece such that a clearance is defined between said abutting rod and said stop piece, a trigger rod further extending horizontally from said slidable member;

a retaining member in the form of a plate, a middle section thereof having a slide means connected to a retractable element and said pivotal connecting means such that it can be horizontally displaced along the surface of said securing member, said retaining member having a fastening rod extending from an inner side thereof;

a button member in the form of a push button, said button member straddling said bearing means, a bottom edge thereof being blocked by said stop piece, and having two side walls respectively provided with a wall hook and a wall rod;

said press member being manipulated downwardly to reduce the height thereof so that said connecting rod of said slidable member displaces as a result of loss of support from said lap piece, with said abutting rod contacting said stop piece, said connecting rod laps the upper portion of said lap piece so that said press member cannot bounce back and be positioned; when said press member is manipulated downwardly, said button member is pressed, an ignition means is simultaneously actuated, and said wall hook causes a gas supply means to supply fuel gas to a burner device, the fuel gas being ignited by means of said ignition means, and said wall rod abutting against said trigger rod; by pressing said retaining member, said fastening rod fastens said gas supply means in position to maintain supply of fuel gas; after use, said button member returns to its original position and is automatically retained by said press member.

2. The safety device for the gas burner of claim 1, wherein said bearing means is formed with a guide groove and a communicating guide chamber between two support posts for insertion of a key neck of said press member such that a press key on one side thereof is exposed between said two support posts, said guide chamber receiving said lap piece.

3. The safety device for the gas burner of claim 1, wherein said connecting and pivotal connecting means of said securing member are respectively comprised of a positioning pin and a positioning groove, said sliding means of said slidable member and said slide means of said retaining member are respectively comprised of an elongated fitting hole and a slide groove in the bottom side thereof, each fitting hole receiving a positioning pin, a retractable element being confined between said positioning groove and said slide groove so that said slidable member and said retaining member can be horizontally displaced and reset on said securing member.

4. The safety device for the gas burner of claim 3, wherein each of said retractable elements is a spring.

5. The safety device for the gas burner of claim 1, wherein a bottom portion of said securing member is provided with a seat groove for connecting a support rod predisposed on the burner, said securing member being provided with a connecting hole in a suitable position for passage of the threaded rod so as to fix said securing member on the top of the liquified gas container.

6. The safety device for the gas burner of claim 1, wherein said stop piece and said lap piece of said press member has an upright post.

7. The safety device for the gas burner of claim 1, wherein each of said retractable elements is a spring.

8. The safety device for the gas burner of claim 1, wherein said button member is provided with a guide piece so as to displace along a support plane predisposed on the gas burner.

9. The safety device for the gas burner of claim 1, wherein rebound of said press member is through a piezoelectric means of said ignition means.

10. The safety device for the gas burner of claim 1, a biasing element is disposed between one side wall of said button member and the burner to facilitate said button member to quickly reset.

11. The safety device for the gas burner of claim 10, wherein said biasing element is a spring.

* * * * *